United States Patent [19]

Barini

[11] Patent Number: 4,786,059

[45] Date of Patent: Nov. 22, 1988

[54] EQUIPMENT WITH ENERGY KNOCKING-DOWN SEPTUM FOR BULLETS, TO BE INSTALLED IN SHOOTING RANGES

[75] Inventor: Alberto Barini, Florence, Italy

[73] Assignee: A B C Appalti Bonifiche e Costruzioni di Elio Floria & C.s.a.s., Italy

[21] Appl. No.: 942,501

[22] Filed: Dec. 16, 1986

[30] Foreign Application Priority Data

Dec. 20, 1985 [IT] Italy ..... 9551 A/85
May 16, 1986 [IT] Italy ..... 9395 A/86

[51] Int. Cl.[4] ..... F41J 1/12; G01L 5/14

[52] U.S. Cl. ..... 273/410; 273/403; 273/404; 73/167

[58] Field of Search ..... 273/404, 408, 410, 407, 273/403; 73/167

[56] References Cited

U.S. PATENT DOCUMENTS

| | | | |
|---|---|---|---|
| 2,411,026 | 11/1946 | Conner et al. | 73/167 |
| 2,772,092 | 11/1956 | Nikoden | 273/410 |
| 3,982,761 | 9/1976 | De Vogelaere | 273/410 |
| 4,470,604 | 9/1984 | Hoffman | 273/410 |

FOREIGN PATENT DOCUMENTS

| | | | |
|---|---|---|---|
| 2847742 | 1/1980 | Fed. Rep. of Germany | 273/404 |
| 3212781 | 10/1983 | Fed. Rep. of Germany | 273/410 |
| 8505672 | 12/1985 | Italy | 273/410 |
| 10992 | 5/1906 | United Kingdom | 273/410 |
| 2065277 | 6/1981 | United Kingdom | 273/410 |

*Primary Examiner*—Richard C. Pinkham
*Assistant Examiner*—Mark S. Graham
*Attorney, Agent, or Firm*—McGlew and Tuttle

[57] ABSTRACT

This invention relates to a knocking-down septum comprising a steel shutter structure on the slats of which a granulated material rests. The granulated material may consist of granules of natural or synthetic rubber, also of recovery rubber and possibly of a self-extinguishing type of rubber, of dry sand, or of a mixture of sand and rubber or the like. This granulated material lies on the slats of the shutter structure in accordance with the shutter's natural angle of repose and is thereby retained by the shutter. When a bullet crosses the thickness of the granulated material the granulated material slows down the velocity of the bullet.

18 Claims, 8 Drawing Sheets

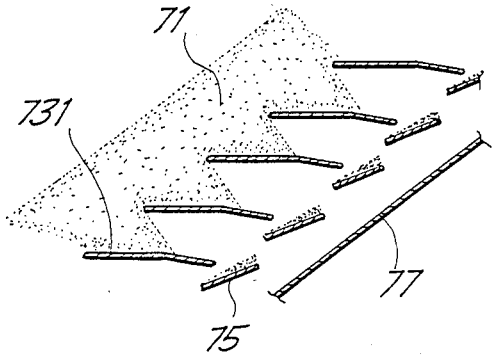
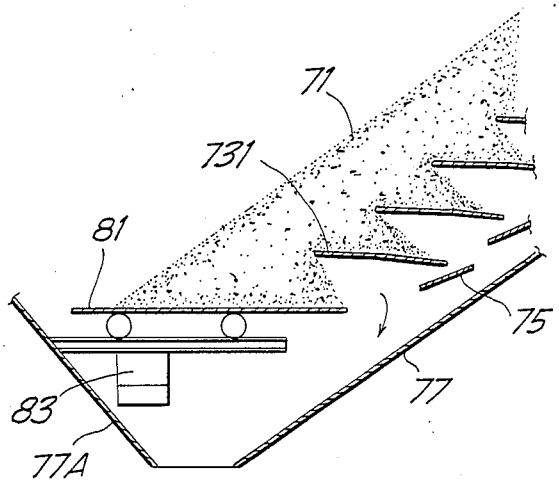
FIG.11
FIG.12
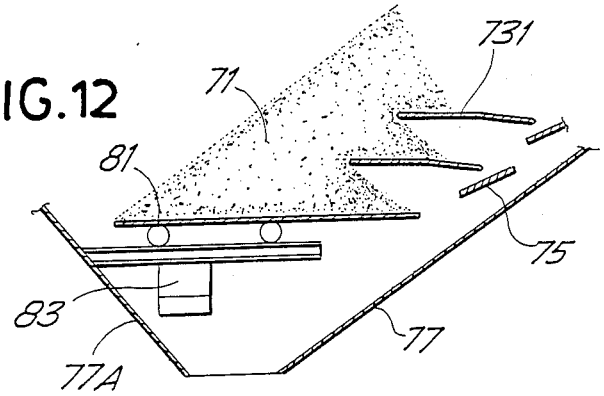

EQUIPMENT WITH ENERGY KNOCKING-DOWN SEPTUM FOR BULLETS, TO BE INSTALLED IN SHOOTING RANGES

SUMMARY AND OBJECTS OF THE INVENTION

The invention relates to an apparatus for lowering the speed of a bullet to an extent that the bullet, striking against a back surface (of steel or other material) even with an incidence angle of ninety degrees, will not be subject to the phenomena of lead sublimation or pulverization. This speed will be indicated in the description as safety speed.

According to the invention, a system is provided having a shutter structure with steel slats, on which a granulated material is made to rest. The material—by lying on the slats of the shutter structure according to its natural angle of repose—is contained by that shutter. This material reduces the speed of the bullets. To do this, it must have a thickness which is a function of the type of the weapons used. The material must consist of granules of natural or synthetic rubber. The material could also be composed of recovery rubber, or self-extinguishing type rubber, or of dry sand or of a mixture of rubber and sand. The slats of the shutter may be horizontal or have an upward inclination.

In an embodiment of the invention, the structure of the shutter defining the exit surface is inclined parallel to the stability surface of the granulated material. In this case, no expedient is necessary to hold the granulated material, and the entrance surface of the bullets is developed with the inclination of the friction cone.

In another embodiment of the invention, the shutter is placed with a less inclined attitude—in respect to the vertical line—than that of the friction cone, and can even be vertically placed. In this case, the braking mass may be held, on the bullets entrance side, by a vertical panel of rubber. This panel can be reinforced with music wires in order to define the entrance surface of the bullets in the knocking-down septum. Alternatively, the entrance surface of the bullets may also be developed with a shutter structure. The advantage of this shutter structure, is that is exhibits slats more widely spaced than those of the shutter structure defining the side of the bullets' exit.

The shutter structure may have such a disposition that one part of the bullet goes directly through the braking layer with a residual kinetic energy which also causes small quantities of granules, as well as bullets previously stopped on the layer to be expelled backwards out of the braking layer.

This falling back of granules and previously stopped bullets may be disposed of by placing, on the back of the shutter structure, a surface for the interception of the bullets and granules falling long the inclined plane. The slats may be slightly inclined downwardly in the direction of the bullets movement (or in the opposite direction). This will ensure the function of partial discharge of the granules with the bullets passing the barrier.

The intercepting surface may be elastically mounted so that it may vibrate by means of the residual energy of the bullets being intercepted by the same surface.

The intercepting surface may be combined in the lower part with a sieve, that is, a classification grate through which the separation of the granules from the bullets is directly provided. These are retained and delivered to a collector. The vibrations ease the descent of the material and the screening thereof.

Just upstream of the grate, a diaphragm may be provided, which retains the material to be graded and ensures the regular delivery thereof to the sieve.

To collect the material falling through the sieve, a transverse conveyor may be provided located therebelow.

An overturnable type collector may be realized for the discharge of the bullets. This collector can perform the discharge into the conveyor during a work phase intended to move away the bullets, after which the conveyor can operate with a reverse motion.

Damping diaphragms vibrating with the intercepting surface, may be inclined upwards, in the direction of the bullets motion, in order to intercept them and dampen their kinetic energy.

The layer thickness of the material supported by the structure may be controlled both upstream—that is in the upper part—and downstream—that is in the lower part—by means of gates which move in their plane. Generally, this plane is a horizontal one.

A lower gate may substantially make up the last of the slats, and can be moved in one direction or the other to increase, or respectively decrease, the thickness. It can also reach a position in which the inclined layer supported by the shutter structure can be almost completely discharged.

The purpose of the invention is to realized an apparatus able to offer—in respect to other known apparatuses—special functional characteristics. In particular, to obtain a soft damping of the bullets' kinetic energy which will not generate lead vapors or dust; to prevent the bullets from stopping stably in the breaking mass, thereby preventing the creation of a so-called "lead-wall"; to obtain an automatic separation of the bullets from the granules in the same butt during the drill, without the aid of machineries, but exclusively by exploiting the gravity and the residual kinetic energy of the bullets.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS

In the drawings:

FIGS. 11 and 12 show an enlarged detailed view of a gate showing two different arrangements;

DESCRIPTION OF THE PREFERRED EMBODIMENTS

Figure 1:
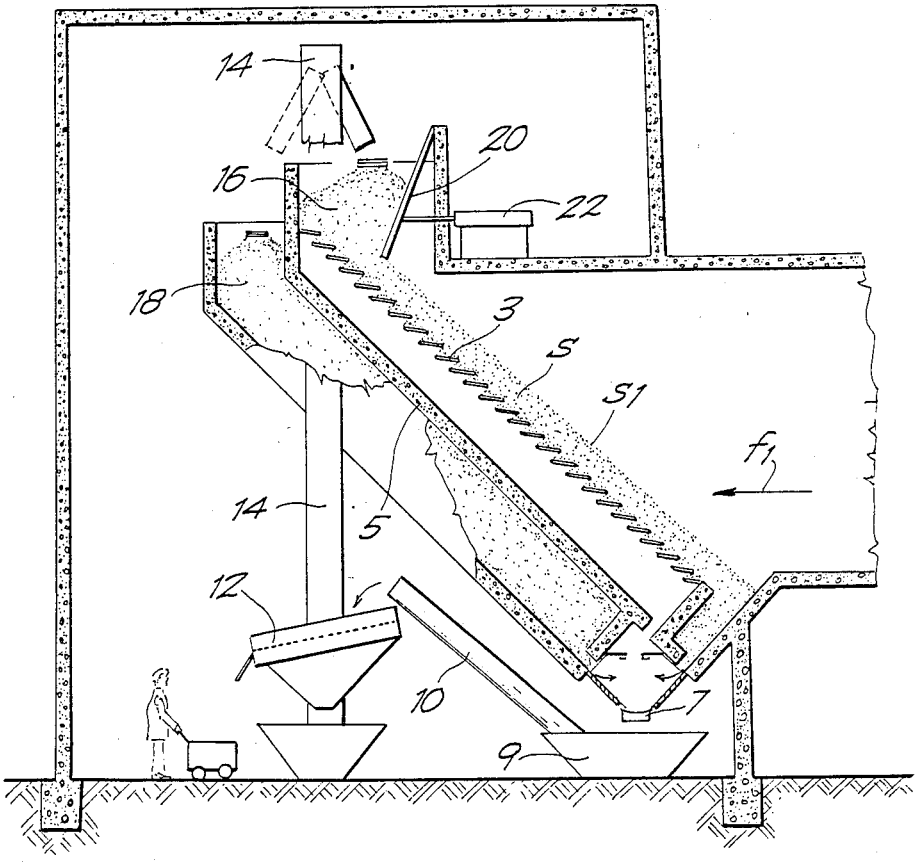
FIG. 1 is a cross sectional view of a first embodiment of the invention.
Figure 2:
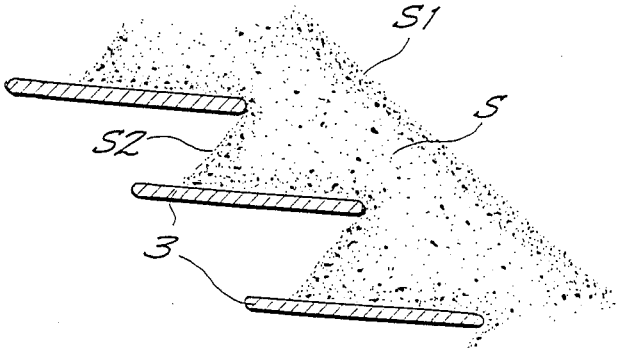
FIG. 2 is an enlarged detailed view of slats shown at FIG. 1.

Referring to the drawings in particular, f1 indicates the incoming direction of the bullets. A septum intended to reduce the bullets energy is defined by a layer S of granulated material, such as rubber material preferably of the fireproof type, and possibly of the rubber recovery type, or dry sand, or a mixture of these materials. This material is disposed of with an inclination of the friction cone that is of the natural declivity of the material and of its granulometry. The layer is defined, in its front surface S1, by the free surface of the material in its natural inclination. The bullets exit surface, that is, the rear surface, is defined by a shutter structure made up of slats 3, which may be made of steel or other suitable material, and with a horizontal or slightly upwardly inclined orientation and in the direction of the arrow f1. Between one slat and the other, however, the material sets itself according to the surfaces S2 which are surfaces of natural declivity as well. The slats may have a thickness in the range of 7–9 mm and an interspace in the range of 200 mm. FIG. 1 shows the structures combined with the septum in question. In particular, a wall 5 is indicated with receives the bullets and the granules dragged along by them. This material is able to be collected on the bottom or discharged directly into a conveyor 7 and amassed in a collector 9, from which it may be then discharged by an elevator 10 onto a sieve 12. This sieve 12 can separate the particles which cross it from the bullets retained by the sieve. An elevator 14 may provide for the discharge of the material into a reservoir 16 overhanging the septum S. This elevator is capable of continuously restoring the configuration of this septum. The material may also be discharged into a reservoir 18 located at the back of the wall 5, for storage, if necessary, for variation of the septum thickness, or for other similar requirements.

A diagram 20 may be adjusted in position through a cylinder-piston cylinder 22. This diaphragm may be moved for positioning its lower edge in order to delimit the thickness of the septum S by the position of the edge, and to change the septum thickness by the displacement of the same edge.

Figure 3:
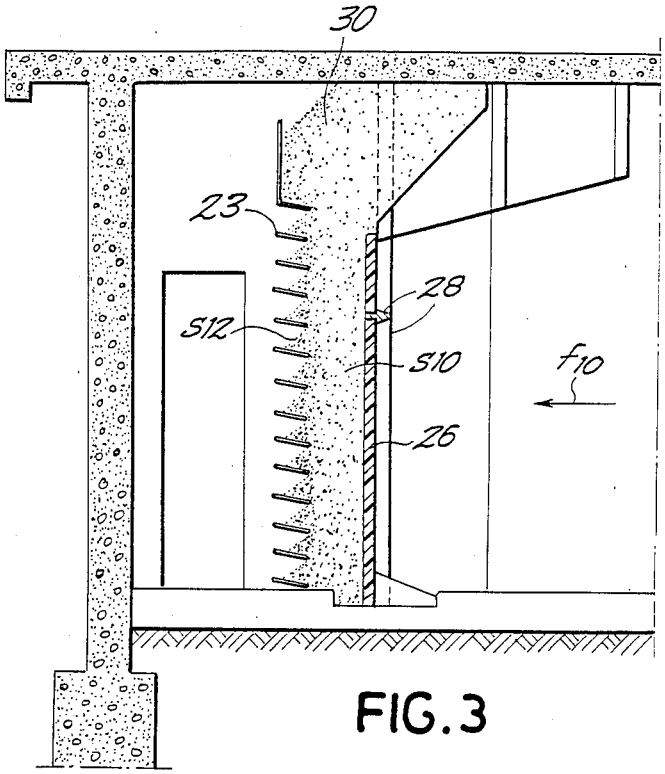
FIG. 3 is a vertical sectional view of a second embodiment of the invention.
Figure 4:
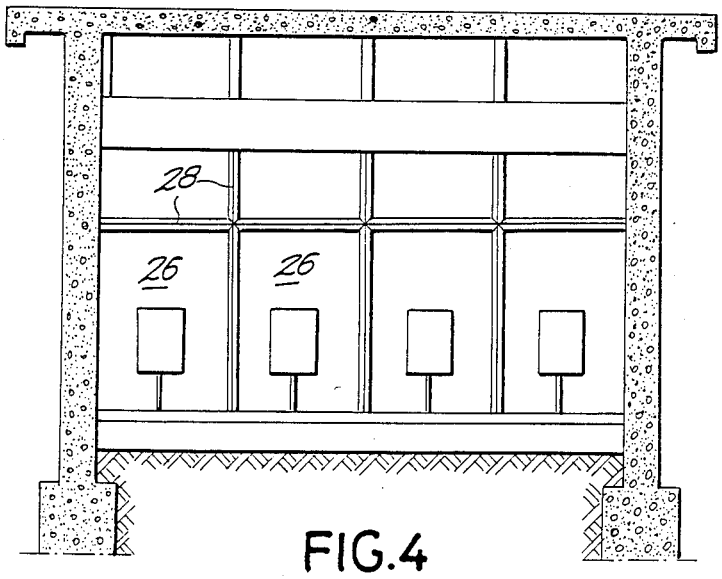
FIG. 4 is a front view of the bullet entrance surface of the embodiment of FIG. 3.

In the embodiment of FIGS. 3 and 4, the septum S10 is defined on the back by a shutter structure having slats 23. These slats are disposed according to a substantially vertical arrangement. This differs from the shutter structure of the previous example which has an inclination corresponding to that of the surface S1. Between the slats 23, the granulated material takes up the inclination of its natural declivity, while the front surface of the bullets entrance (which bullets arrive according to the arrow f10) is defined by a vertical wall 26 which is crossed by the bullets and may be made of rubber (even a regenerated type of rubber) reinforced with music wire or the like. This wall can be subdivided in panels variously replaceable and mounted on a framework 28 as shown in FIGS. 3 and 4. Even in this case, a reservoir 30 is provided, corresponding to the one indicated by 16 in the preceding example and being suitably restorable. As the rear of the shutter structure, a space will be provided for the recovery of the material formed by the bullets that have gone through the septum and by the granules that are dragged along by the bullets. According to the embodiment of FIGS. 3 and 4, the recovery made by performed manually depending, however, on the amounts of material to be recovered.

Figure 5:
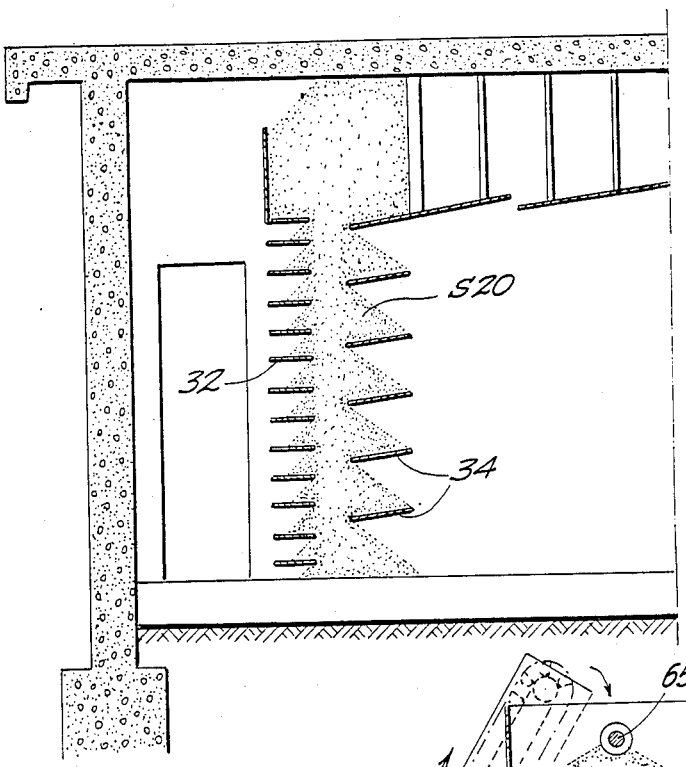
FIG. 5 is a cross sectional view of another embodiment of the invention.
Figure 6:
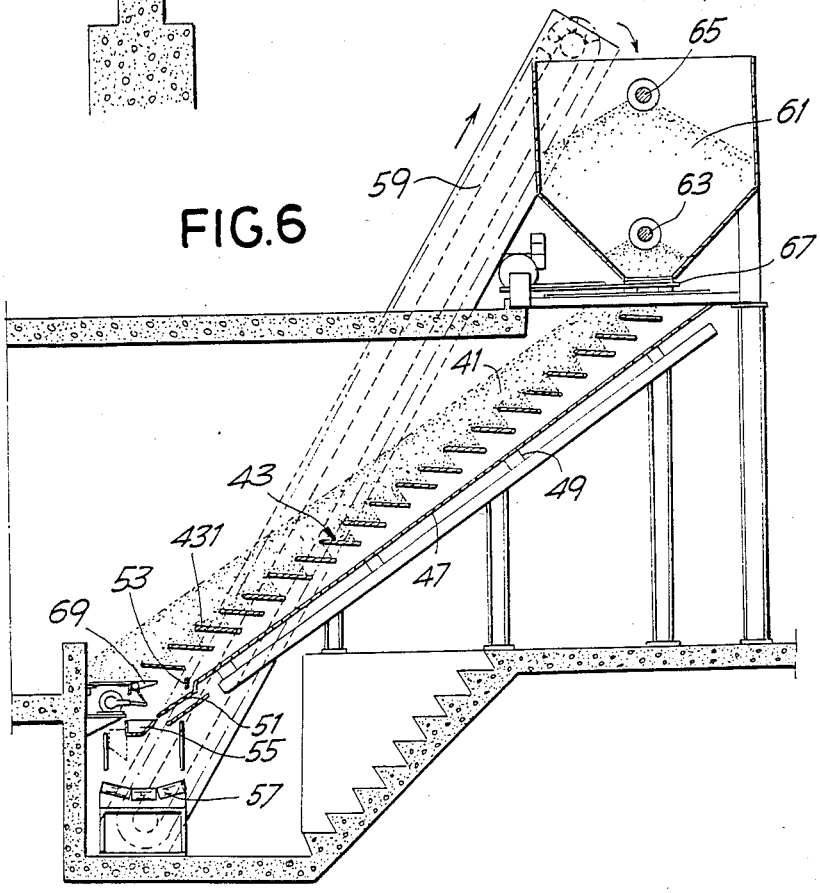
FIG. 6 is a cross sectional view of another embodiment of the invention.
Figure 7:
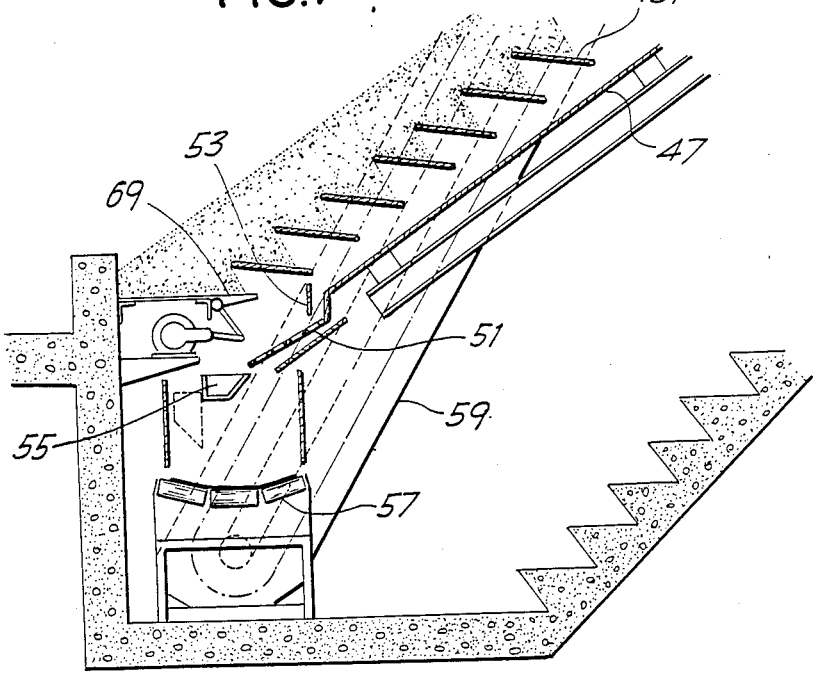
FIG. 7 and 8 are enlarged detailed views of slats shown in FIG. 6.
Figure 8:
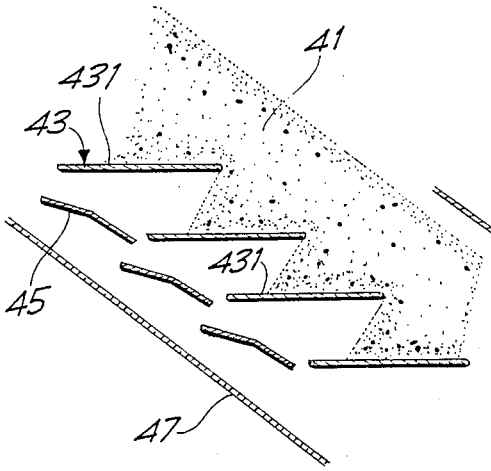
Figure 9:
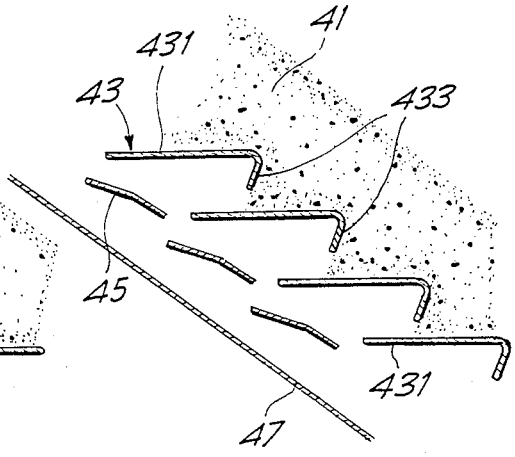
FIG. 9 is an enlarged detailed view similar to FIG. 8 showing a possible modified embodiment.

FIG. 5 shows an embodiment wherein the rear side of the septum S20 is defined by a shutter structure with slats 32, similarly to FIG. 3. On the front side, on which the bullets arrive, the septum is defined by another shutter structure, with more widely spaced slats 34. This arrangement reduces the percentage of bullets that may strike the slats edge. The slats 34 may have a limited inclination in respect to the incoming bullets trajectory. The inclination is held within such limits as to prevent the possible impact of the bullets against the lower surface of the slats 34.

According to the embodiment of FIG. 5, the bullets go through the rubber panel, when present, and through the braking mass, as far as it encounters the plane determined by the tips of the slats, at a speed equal to or lower than the safety speed. The bullets which do not encounter the tip of the slats 23 or 32 will continue their run until they impinge against a surface. These bullets are then easily collected. The bullets which might strike the tips of the slats will also be stopped and dragged out of the shutter by the bullets that would happen to pass in the immediately vicinity. A possible impact between two bullets will not create any inconvenience as it takes place at the safety speed.

Above the shutter, by means of gravity fall, the reservoir will provide for the restoration of the granules that the bullets may have dragged out of the knocking-down septum.

What comes out of the knocking-down septum can be selected and recycled by various screening and handling devices. In the applications regarding small shooting ranges with poor activity, it is possible to proceed by manual means.

According to FIGS. 5 to 9, a braking layer 41 is created, made of granulated material, which develops with the inclination of the angle of friction and is supported by a shutter structure 43 having a corresponding inclined development.

The braking layer 41 of granulated material may consist of sand, granules of rubber or plastics, or a mixture of the same or similar materials. These materials may even be of an organic origin. The nature and the thickness of the layer will be calculated to prevent the formation of lead oxides or powders upon the impact with the most advanced part of the shutter 43. The shutter structure 43 comprises a plurality of slats 431 which are almost horizontal or slightly inclined, either in the direction of the bullets motion or in the opposite direction. The shutter structure has the purpose of retaining the granulated material while permitting the braking material and the bullets to come out. A suitably limited thickness of the layer 41 is established for this purpose. The slats 41 of the shutter may have a particular shape, possibly with a set of sectors 433 (see FIG. 9) limiting the surface of the bullets' exit. The assembly of the shutter 43 and of layer 41 makes up an energy knockingdown septum, such that the bullets may escape from the rear part with limited residual kinetic energy, dragging along small quantities of granules as well as bullets possibly retained by the layer of granules.

A set of damping and safeguarding diaphragms 45 is provided behind the knocking-down septum for intercepting the bullets which escape with still some kinetic energy. These diaphragms constitute a safety measure particularly useful for arms testing benches on which machine guns with great shot frequency are tested. Bullets from such guns are fired at short intervals and strike the butt at the same point. This may decrease the efficiency of the braking layer. The presence of the diagphragms is useful also in the case of relatively large bullets and/or of relatively powerful weapons.

At the back of diaphragms 45, another inclined plane 47 is provided. Against which the expelled bullets and granules strike and then descend along the same plane, the dynamics of which is explained below.

An elastic suspension 49 may be provided for supporting the inclind plane 47 with an underlying grate 51 being inclined in the same manner as the plane 47 and formed integral therewith. This grate 51 is apt to be crossed by the granules and to retain the bullets. Just upstream of the grate 51, a diaphragm 53 for loading the grate 51 is disposed, which at the same time provides for lowering the speed of the granules and bullets that slide downwardly along the inclined plane 47.

A bullet container 55 made up of an overturnable basket is arranged for receiving what grate 51 has retained. This basket 55, as it rotates, discharges bullets down into an underlying container or a transverse conveyor belt 57.

The horizontal conveyor 57 has the purpose of conveying the expelled granules being screened by the grate 51 to a bucket elevator 59. This may be done with continuous or intermittent operation either during the drill sessions or after the drill. In some cases, even a non-mechanized handling may be provided if the quantity of granules to be recycled is limited. At the end of the drill, the conveyor 57 may be used for transporting the bullets into a suitable container, by reversing the run direction and replacing the reception means of the same conveyor.

The bucket elevator 59 is intended to convey the granulated material to a reservoir-lung 61. This elevator may be made up of a belt conveyor, a screw or similar machine. The reservoir-lung 61 may be adapted to contain the whole braking mass of the layer 41 or when architectural problems prevent this, the reservoir need only contain what is necessary for operation. In the reservoir-lung, a lower screw 63 may be provided for the distribution of the granulated material in a transverse direction during the drill. Alternatively, depending on the capacity of the reservoir 61, an upper screw 65 may be provided for distribution of the whole braking mass in a transverse direction. At the bottom of the reservoir 61, a mobile gate 67 is provided shaped as a horizontal shutter. This mobile gate 67 serves to adjust the thickness of the layer 41 and is able to cut off the communication between the reservoir-lung 61 and the formation zone of the layer 41.

A lower gate 69 is also provided, which is intended to decrease the thickness of the layer 41 and to empty the butt unit by discharging the layer 41, possibly onto the transverse conveyor 57. The gate 69 is adjustable for dosing the discharge velocity.

The illustrated elements are necessary for the running of a shooting range where drills with various types of weapons providing great shot intensity is performed. For more limited uses, some elements can be abolished, especially those relating to the handling of the granuled material falling on the plane 47.

The bullets being shot, sink into the braking layer and thus some of them may escape directly from the knocking-down septum or layer 41 through the spaces between the slates 431. Other bullets, by impinging on the slat 431 (or on a septum 433, if any), stop in the mass of granules. This takes place also for the bullets that divert in the layer 41 and present themselves transversely disposed. In any case, the energy of the outcoming bullets will cause the expulsion of small quantities of the granulated material as well as of bullets contained therein, on the back side of the shutter. The phenomenon will repeat itself at each shot. This will cause a progressive advancement of the stopped bullets toward the exit from the knocking-down septum and thus their expulsion will take place. While time elapses the number of bullets instantly present in the layer 41 will become stabilized. Only a limited fraction of the granules go beyond the assembly of the shutter 43 as a mixture of granules and bullets. This mixture falls on the inclined plane 47 and goes down along the same to be graded by the grate 51. The granulated material will reach the belt 57, the elevator 59 and finally the reservoir 61. The bullets will be collected into the basket 55, from which they will be moved away at the end of one or more drills.

The possible residual energy of the bullets which get over the butt will be taken up by the assembly 45 and 47, which will be made to vibrate and thereby ease the dynamics of the operation.

Consequently, the described butt operates by soft damping requiring a resorting of only limited fractions of granules and restoration of the braking mass, without the use of regenerating motorizations. the described butt operates by exclusively exploiting the gravity and the kinetic energy of the bullets and avoiding at the same time any form of progressive accumulating of bullets, that is, avoiding the formation of the so-called lead wall.

The rotating basket 55 ensures the collection and then the discharge of the bullets.

The elastic suspension 49 of the inclined plane 47—with rubber buffers, silent-blocks, or springs—exploits the residual energy of the bullets. In fact, this suspension has the purpose of enhancing the vibrations caused by the bullets upon their impact on the inclined plane 47, which vibrations also influence the grate. Consider, for example, a typical machine-gun which has a frequency of 1000 shots per minute, with initial speeds of 980 m/s and a bullet of 7 g at the residual speed of 100 m/s (which is a safety speed at which it can come out when directly passing through the slot between two slats 431). Such a bullet has a residual kinetic energy of 35 kgm and thus causes a vibration. The bullets coming out directly, besides causing locks and the consequent vibration, determine as well the expulsion of a relatively small quantity of granules along with the bullets stopped therein. By varying the inclination of the slats and/or thickness of the layer of granules, it is possible to vary the quantity of granules discharged by each bullet of a certain weight.

In any case, during the same drill session, there is obtained the simultaneous and automatic resorting, that is, the separation of the braking granualted material and of the bulletes, without any motorization.

Figure 10:
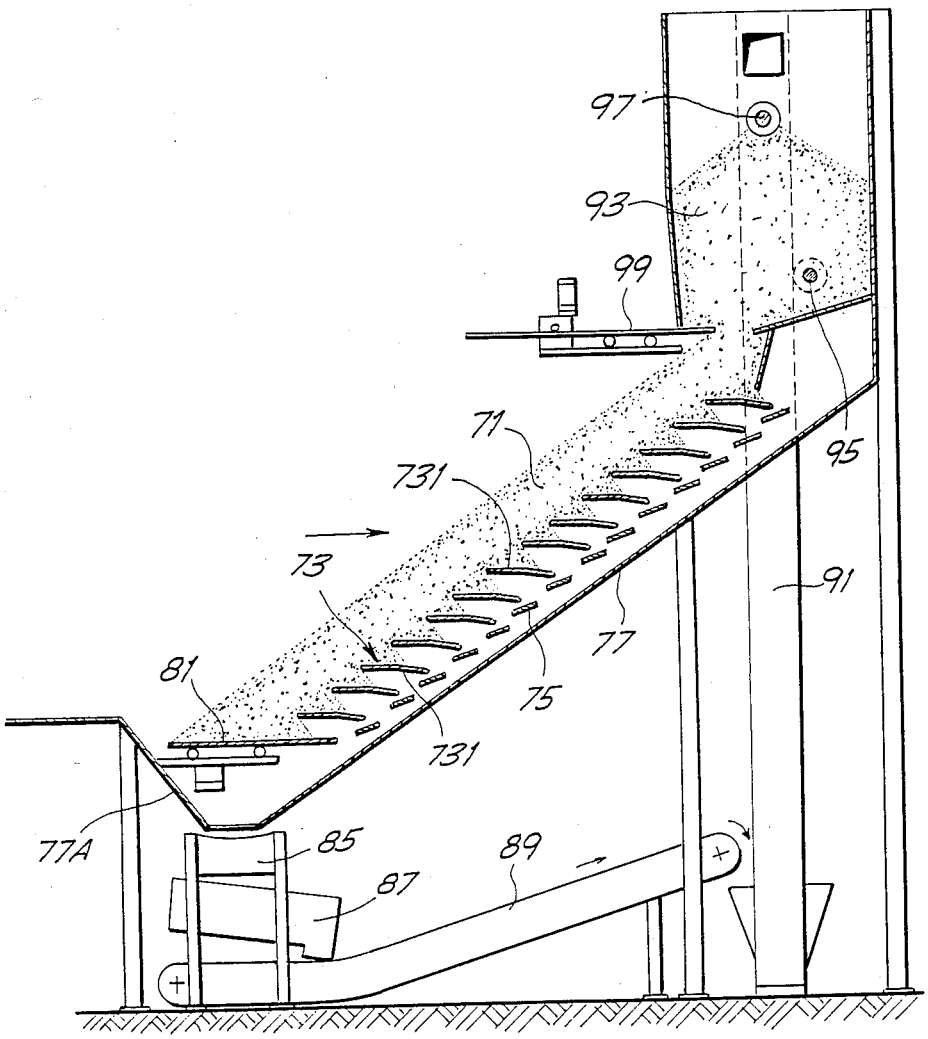
FIG. 10 is a cross sectional view of a still another embodiment of the invention.

In FIGS. 10 to 12, numeral 71 indicates the braking layer of granulated material, which is supported by the slats 731 of a shutter-like assembly 73. Behind the slats 731, damping diaphragms 75 are disposed which are similar to those indicated by 45. At the back of the diaphragms 75 the inclined plane 77 is disposed, which is similar to that indicated by 47 and which may be mounted with vibrating means like those indicated by 49. At the lower end of the shutter 73, a lower gate 81 is provided, which can be moved in its own plane (mostly a horizontal plane). This gate can be moved by a motorized rack system 83. The gate 81 is located above a hopper defined by the inclined plane 77 and by an opposite wall 77A. Below the hopper 77 and 77A, a conveyor 85 is provided. This conveyor 85 discharges the granulated material and the bullets which it has collected and transported, into a sieve 87 capable of separating the bullets from the granulated material. The granulated material is delivered from a conveyor 89 to a bucket or similar elevator 91, having the same function as the elevator 59. Numeral 93 indicates a reservoir-lung similar to that indicated by 61, with which two screw distributors 95 and 97, similar to those indicated by 63 and 65, are combined. A gate 99 movable in its own plane has the functions of that indicated by 67 in order to adjust the thickness of the layer 71 in the upper part of the same.

The gate 81 may be moved to adjust the thickness of the layer 71 in the lower part thereof and, in particular, to prevent the thickness of the braking layer from being increased due to landslips or slidings of the granulated material during the drill. In fact, in the arrangement shown in FIG. 12, the thickness of the layer 71 is prevented from increasing because the surplus of granulated material, instead of piling up, discharges itself, according to the arrow f71, from the edge of the gate 81 which, looking at FIG. 12 is on the left side. By moving the gate, it is possible to adjust the maximum thickness of the lower layer 71. The gate 81 is also intended to allow the discharge of the granulated material for the emptying out of the layer 71, by moving the gate 81 to the left, (see drawing) beyond the position of FIG. 11. In fact, the material falls down from the right edge (see FIG. 11) of the gate 81, when it is displaced in the above-mentioned manner, until the layer is exhausted. A residue of granulated material remains on the slats, other granulated material may be retained on the diaphragms 75 in substantially negligible amounts.

Figure 13:
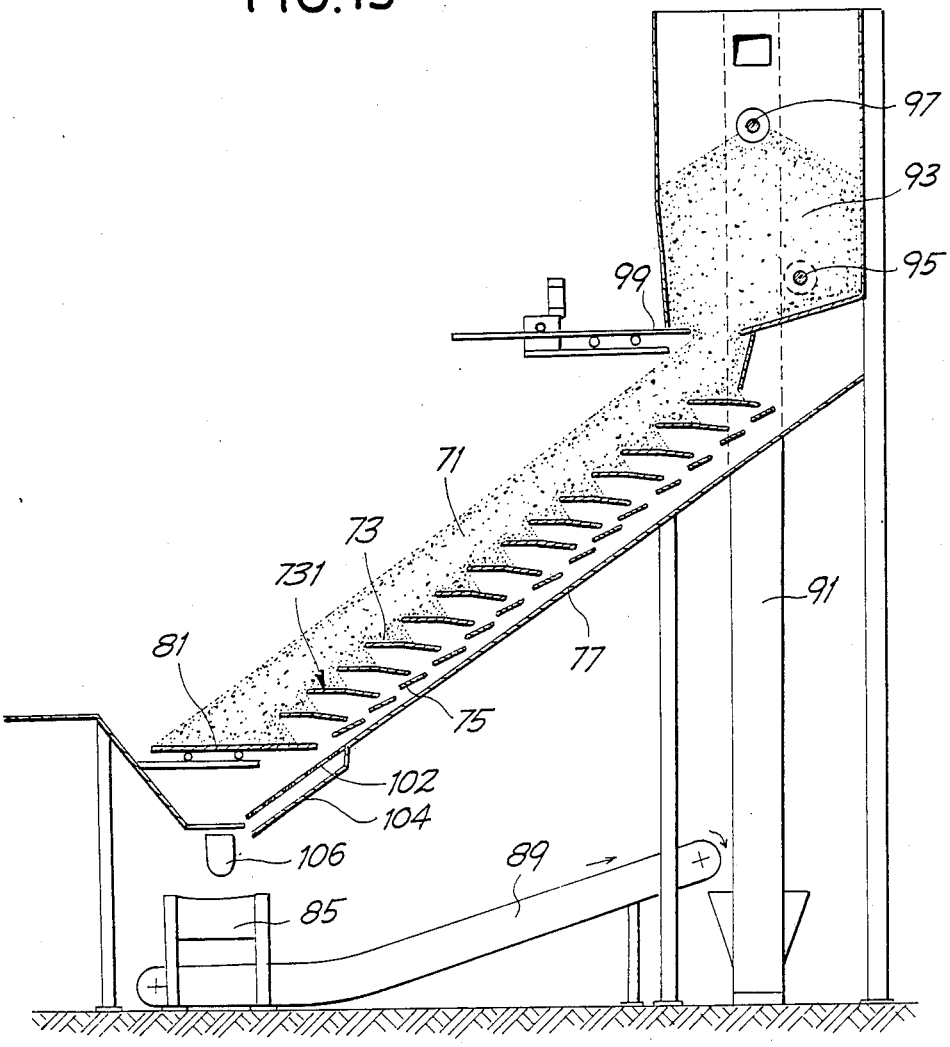
FIGS. 13, 14 and 15 are cross sectional views of yet further embodiments of the invention.
Figure 14:
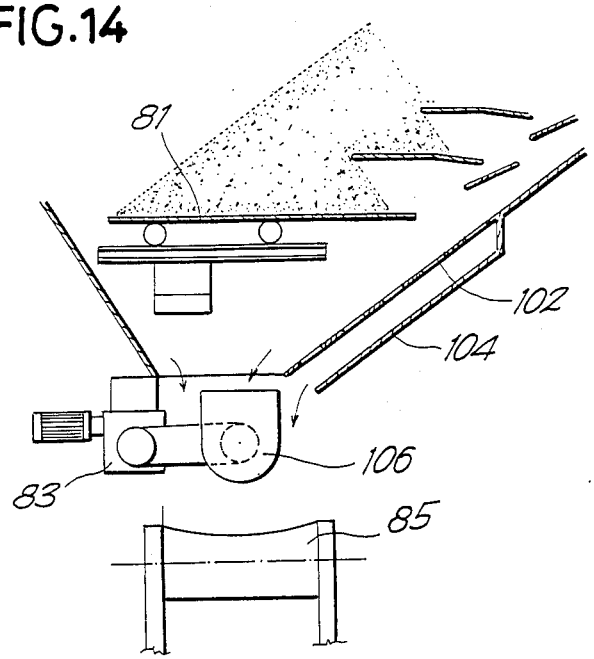
Figure 15:
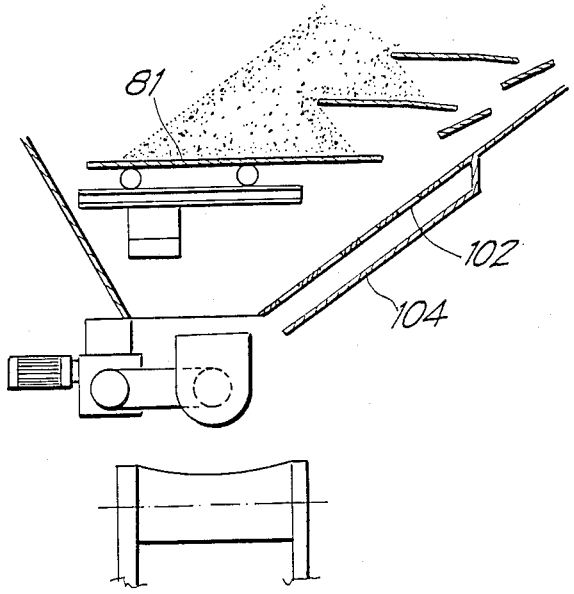

In FIGS. 13 to 15, the disposition below the gate 81 is shown modified. A separating grate 102 is provided, similar to that indicated by 51 to make the granulated material fall on an inclined plane 104 which thus falls onto the conveyor 85. The bullets retained by the grate 102 fall therealong to be collected into a container 106 similar to that indicated by 55.

While specific embodiments of the invention have been shown and described in detail to illustrate the application of the principles of the invention, it will be understood that the invention may be embodied otherwise without departing from such principles.

I claim:

1. An apparatus for installation in shooting ranges comprising an energy knocking-down septum for bullets having opposite bullet entry and bullet exit sides, the septum including a shutter structure having slats arranged one above another and a braking mass of unconfined granular material resting on the slats of the shutter structure in the natural angle of repose and thereby being retained as a continuous upstanding wall portion, the shutter defining the exit side of the septum with an exit face free of the braking mass in bullet receiving condition.

2. An apparatus according to claim 1, wherein the slats have major surfaces which are substantially horizontal.

3. An apparatus according to claim 1, wherein the slats of thein shutter have the inclination directed upwards and towards the transit direction of the bullets.

4. An apparatus according to claim 1, wherein the shutter is inclined so as to be approximately parallel to the stability surface of the granulated material; the surface of the bullets entrance being developed along the inclination of the friction cone of the granulated material.

5. An apparatus according to claim 4 further comprising a hopper reservoir of the granular material mounted above the septum and diaphragm means mounted between the hopper and the septum for changing the discharge conditions of the granular material from the hopper thereby to change the septum thickness.

6. An apparatus according to claim 1, wherein the shutter is less inclined, with respect to the vertical, than the angle of the friction cone of the granulated material, a further shutter structure being provided at the entry side of the septum for retaining the braking mass between the shutter structures.

7. An apparatus according to claim 6, wherein the slats of the shutter structure at the bullets entry side are more widely spaced than those of the shutter structure on the exit side of the bullets.

8. An apparatus according to claim 6 wherein the slats are vertical.

9. An apparatus according to claim 1, wherein said shutter structure has such a disposition that at least a proportion of bullets go directly through the braking mass with a residual kinetic energy which causes also the expulsion of fractions of granules and of bullets that have been stopped in the braking mass from the exit face; and wherein an inclined interception surface is disposed opposite and spaced from the exit face for the interception and collection of bullets and granules.

10. An apparatus according to claim 9, wherein means are provided to mount the intercepting surface elastically for vibration by the residual energy of the bullets which are intercepted by said surface.

11. An apparatus according to claim 9, wherein the interception surface is combined in a lower part with a classification grate for the separation of the granules from the bullets that are retained by the grate and delivered thereby to a collector.

12. An apparatus according to claim 9, wherein, damping diaphragms are provided between the intercepting surface and the "exit" face of the septum for vibration therewith, the diaphragms being inclined upwards and in the direction of the bullets motion, in order to intercept the bullets and dampen their kinetic energy.

13. An apparatus according to claim 9, wherein the slats are slightly inclined downwards and in the direction of the bullets motion.

14. An apparatus according to claim 9 wherein gates are provided at the upper and lower extremities of the septum, respectively, and means are provided for mounting each gate for movement transversely of the septum to adjust the thickness of the wall portion of the braking mass supported by the shutter structure.

15. An apparatus according to claim 11, wherein, a diaphragm is provided at a location immediately upstream of the grate for retaining the material to be classified.

16. An apparatus according to claim 11, wherein, a transverse conveyor is provided located below the grate for conveyance of the material pressing therethrough.

17. An apparatus according to claim 15, wherein the bullets collector is overturnable to the discharge of bullets therefrom into said conveyor which can be reversed.

18. An apparatus according to claim 14, wherein the lower gate constitutes the lowest of the slats, and is movable to a position in which it allows the discharge of the wall portion supported by the shutter structure.

* * * * *